US006524364B1

(12) United States Patent
Ederyd

(10) Patent No.: US 6,524,364 B1
(45) Date of Patent: Feb. 25, 2003

(54) CORROSION RESISTANT CEMENTED CARBIDE

(75) Inventor: Stefan Ederyd, Saltsjö-Boo (SE)

(73) Assignee: Sandvik AB, Sandviken (SE)

( * ) Notice: Subject to any disclaimer, the term of this patent is extended or adjusted under 35 U.S.C. 154(b) by 0 days.

(21) Appl. No.: 09/486,371

(22) PCT Filed: Sep. 4, 1998

(86) PCT No.: PCT/SE98/01572

§ 371 (c)(1),
(2), (4) Date: May 15, 2000

(87) PCT Pub. No.: WO99/13119

PCT Pub. Date: Mar. 18, 1999

(30) Foreign Application Priority Data

Sep. 5, 1997 (SE) ..... 9703202

(51) Int. Cl.[7] ..... C22C 29/08
(52) U.S. Cl. ..... 75/240; 419/18
(58) Field of Search ..... 419/18; 75/240

(56) References Cited

U.S. PATENT DOCUMENTS 3,677,772 A 7/1972 Rymas
4,359,335 A * 11/1982 Garner ..... 75/208 R
4,497,660 A * 2/1985 Lindholm ..... 75/240
4,956,012 A * 9/1990 Jacobs et al. ..... 75/236
5,041,261 A * 8/1991 Buljan et al. ..... 419/11
5,151,247 A * 9/1992 Haglund et al. ..... 419/13
5,310,605 A * 5/1994 Baldoni, II et al. ..... 428/569
5,593,474 A * 1/1997 Keshavan et al. ..... 75/240
5,681,783 A * 10/1997 Nilson et al. ..... 501/87
5,773,735 A * 6/1998 Dubensky et al. ..... 75/240
5,830,256 A * 11/1998 Northrop et al. ..... 75/236
6,086,650 A * 7/2000 Carpenter ..... 75/240
6,241,799 B1 * 6/2001 Galli ..... 75/236

OTHER PUBLICATIONS

ASM Handbook, vol. 7, Powder Metallurgy, pp. 799–800, 1984.*

Derwent Information Services, File 351, Derwent WPI, Dlalog accession No. 008910673, WPI accession No. 92–037942/199205, (Sumitomo Electric Ind Co), "Cemented Carbide for use in mfg. rolling rolls—based on tungsten carbide, contg. cobalt, nickel and chromium", & JP,A,3285039, 19911216, 199205 B.

* cited by examiner

*Primary Examiner*—Daniel J. Jenkins
(74) *Attorney, Agent, or Firm*—Burns, Doane, Swecker & Mathis, L.L.P.

(57) ABSTRACT

A corrosion and oxidation resistant cemented carbide contains WC and 6–15 wt. % binder phase whereby the binder phase contains 8–12 wt. % of a corrosion resisting addition with an average WC grain size of 3–10 $\mu$m. Cemented carbide is obtained with selection of a total carbon content of 6.13–((0.05±0.007)×binder phase content in wt. %).

12 Claims, 1 Drawing Sheet

CORROSION RESISTANT CEMENTED CARBIDE

The present invention relates to corrosion resistant cemented carbide. By using a carefully controlled manufacturing process a cemented carbide with corrosion resistant binder phase and coarse carbide grains has been obtained.

Cemented carbide for corrosion resistance demanding applications such as seal rings, bearings, bushings, hot rolls, etc. generally has a binder phase consisting of Co, Ni, Cr and Mo where the Cr and/or Mo addition acts as corrosion inhibiting additions. An example of such a cemented carbide is disclosed in EP 28 620. A disadvantage with the Cr and/or Mo additions is that they, particularly Cr, also act as grain growth inhibitors which means that it is not possible to make corrosion resistant cemented carbide with a coarse grain size. The above mentioned EP 28620 discloses a WC grain size <2 μm.

It has now surprisingly been found that if the binder phase is saturated with respect to carbon then the grain growth inhibiting effect of Cr and/or Mo is inactivated and grain growth during sintering takes place. As a result corrosion resistant cemented carbide with coarse WC grain size is obtained. The average WC grain size shall be 3–10 μm, preferably 4–8 μm, most preferably about 5 μm. The cemented carbide according to the invention shall preferably be free of graphite. However, a certain graphite porosity <CO2 can be accepted in the interior of the body, but in the surface region, where corrosion could occur, the graphite can act as a galvanic element and therefore should be avoided. A surface zone free of graphite should therefore be present in the cemented carbide. Depending on the application the graphite free surface zone could have a thickness of a few microns up to several millimeters.

Cemented carbide according to the invention should have a content of binder phase from 6 to 15 weight-%, preferably 8 to 12 wt-%. In a first embodiment the binder phase consists of Co+Ni with a ratio Co/Ni of 0.3–3, preferably 0.75–1.25, most preferably about 1 and with a preferred content of about 10 wt-%. In a second embodiment the binder phase shall consist of 8–9 wt-% Ni. In addition to WC other cubic carbides up to 5 wt-% may be present.

The total carbon content shall be in the interval of 6.13–(0.05±0.007)×binder phase (Co+Ni) content in wt-%.

The content of Cr and/or Mo should be such that the binder phase is saturated with respect to these elements. An amount of 8 to 12 wt-% of Cr+Mo in the binder. gives the optimum corrosion resistance. A higher content of Cr and Mo only results in formation of the corresponding carbides. Preferably only Cr should be used as corrosion decreasing element. Mo is preferably added-for applications including chloride exposure. The amount of Mo in the binder phase should preferably be 0.5 to 5 wt-%.

According to the method of the present invention powders forming the hard constituents and powders forming the binder phase are wet milled together, dried, pressed to bodies of desired shape and sintered. The powder mixture shall have such a carbon content to give a carbon content of the sintered bodies according to above. In order to ensure the high carbon content sintering shall take place at a temperature in the higher end of the allowed temperature range. For the binder phase contents according to the invention a temperature in excess of 1550° C. is suitable. Cooling from sintering temperature shall be made as quickly as possible generally at a speed in excess of 15° C./min down to 1100° C.

The material according to the invention is particularly useful for seal ring applications in pumps used in fresh water or sea water with demands on high pV-values. Typical working conditions for the pump are a working pressure exceeding 0.5 Mpa with a running speed of 2500 rpm.

EXAMPLE 1

Figure 1:
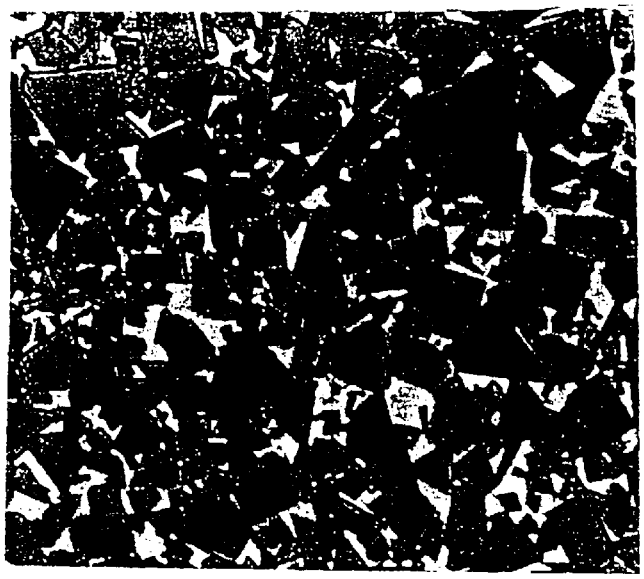
FIG. 1 shows the microstructure in 1700× magnification of a cemented carbide according to the invention.
Figure 2:
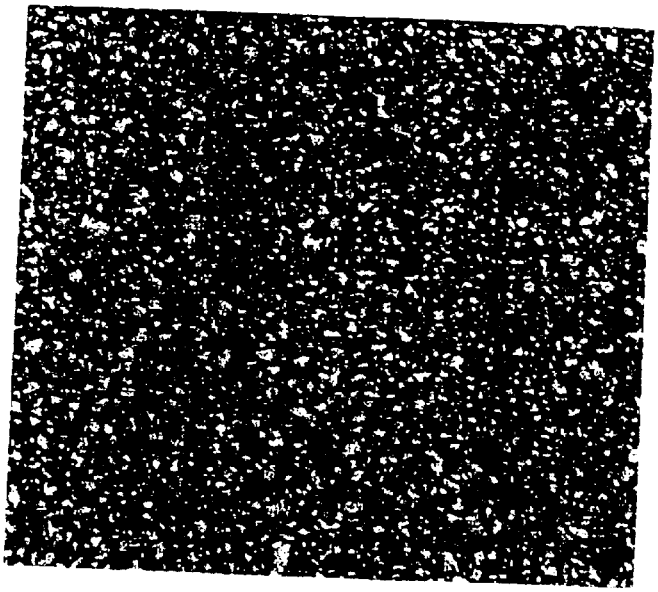
FIG. 2 shows the microstructure in 1700× magnification of a cemented carbide with the same composition but sintered according to prior art.

Cemented carbide for seal rings were made with the composition of 91% WC, 8% Ni, 0.7% Cr and 0.3% Mo. Half of the rings was according to the invention sintered at 1570° C. and cooled from sintering temperature with a speed of 13° C./min. To the powder had been added additional carbon (soot) and as a result the rings had a carbon content of 5.70 wt-%. The-resulting microstructure had an average WC grain size of 5 μm, as is evident from FIG. 1. The other half was sintered at 1520° C. according to prior art and had a carbon content of 5.64 wt-% after sintering and an average WC grain size of 1 μm, FIG. 2.

EXAMPLE 2

The cemented carbide rings from example 1 were tested according to a standardized test method with one stationary ring and one rotating ring of the same composition. The testing was performed in different corrosive media with different pressures acting on the rings. The results are based on three pairs of each ring type.

Temp: 40° C., Time: 700 hours, Speed: 3000 rpm. After each 100 hour the rings were inspected regarding wear and failures.

The tests showed the following results.

Test 1.

Material according to prior art. Medium: Water, Pressure: 0.3 MPa

Results: Wear: 0.2 μm, Leakage of pump medium: 0.1 ml/h.

Thermal cracks and chipping occurred in the seal surface.

Material according to the invention. Testing facilities as above.

Results: Wear: 0.1 μm. Leakage of pump medium: 0.05 ml/h.

The-seal rings had a good surfaces without cracks.

Test 2. Material according prior art. Medium: 3% NaCl, Pressure: 0.5 MPa.

Results: Wear: 1.4 μm, leakage of pump medium: 0.1 ml/h.

Hard worn. Small thermal cracks. Severe chipping occured in the seal surface.

Material according to the invention. Testing facilities as above.

Results. Wear: 0.2 μm. Leakage of pump medium: 0.07 ml/h.

No corrosion was shown. The seal surfaces were in good shape and no cracks or chipping had occurred in the surface.

EXAMPLE 3

Seal rings were made of cemented carbide according to the invention with the composition of 90% WC, 4.7% Co, 4.3% Ni and 1% Cr. The sintering procedure was performed at 1570° C. with a cooling speed of 15° C./min. The cooling atmosphere was hydrogen gas. To the powder had been added additional carbon (soot) and as a result the rings got a carbon content of 5.65 wt-%. The microstructure had a nice and even sintered structure with an average WC grain size of 5 μm.

Corresponding seal rings according to prior art were manufactured with a carbon content of 5.52 wt-% Carbon and sintered at 1450° C. The microstructure showed a nice and even sintered structure with an average WC grain size of 1.8 μm.

Three sets of seal rings from each iteration were manufactured. The OD of the rotating and stator ring was 175 mm. The ID was 150 mm. The seal surface had a width of 3 mm. Field testing was performed with six propeller pumps, with a 60 kW motor plus accessories. The depth was 30 m in sea water. Service of the pumps was performed after 2100 hours running time. The inspection showed that all seal ring packages with the cemented carbide material according to prior art had thermal cracks in the seal surface. One of the seal ring packages had caused leakage due to a crack through the seal ring. All ring packages according to prior art showed cracks that gave chipping (pop-ups) of the material from the seal surface. This phenomena is detrimental for the seal application and could lead to a catastrophic failure.

The seal rings according to the invention also show thermal cracks in the seal surface, but no chipping of the cemented carbide material could be observed from the seal surface.

The seal rings according to the prior art were scrapped and exchanged by other seal rings. The rings according to the invention were running another 2100 hours without any pre-treatment of the seal surfaces. The inspection after the second test period gave the same result according to the thermal crack behaviour.

No chipping had occurred in the seal surface and the seal rings could be used again in the pumps.

The wear of the seal surfaces was not a limiting factor in the application and no measurement was performed.

It was evident that the cemented carbide according to the invention gave a much reliable result and did not risk the pumps in the application.

What is claimed is:

1. Corrosion and oxidation resistant cemented carbide containing WC and 6–15 wt-% binder phase whereby the binder phase contains 8–12 wt-% Cr+Mo, an average post-sintered WC grain size is 3–10 μm and the total carbon content is in the interval of 6.13−((0.05±0.007)×binder phase content in wt-%).

2. Cemented carbide according to claim 1 wherein the average WC grain size is 4–8 μm.

3. Cemented carbide according to claim 1 wherein the average WC grain size is about 5 μm.

4. Cemented carbide according to claim 1 wherein the content of binder phase is 8–11 wt-%.

5. Cemented carbide according to claim 1 wherein the binder phase has a Ni+Co content of about 10 wt-% with a Co/Ni-ratio of 0.75–1.25.

6. Cemented carbide according to claim 1 wherein Mo is not present in the binder phase.

7. Method of making a corrosion and oxidation resistant sintered cemented carbide containing WC grains with an average post-sintered grain size of 3–10 μm and 6–15 wt-% binder phase whereby the binder phase contains 6–11 wt-% Cr+Mo, the method comprising milling a mixture of powders forming the hard constituents and powders forming the binder phase, drying, pressing of the powder mixture to form bodies of desired shape and sintering, wherein the powder mixture has a carbon content to give a carbon content of the sintered body of 6.13−((0.05±0.007)×binder phase content (wt-%)).

8. Method according to claim 7 wherein sintering takes place at a temperature above 1550° C.

9. Method according to claim 7 further comprising cooling ifrom sintering temperature at a speed of at least 15° C./min down to 1100° C.

10. Cemented carbide according to claim 1, wherein the cemented carbide comprises a surface zone free of graphite.

11. Cemented carbide according to claim 1, wherein the binder phase comprises 8–9 wt. % Ni.

12. Cemented carbide according to claim 1, wherein the binder phase comprises 0.5–5 wt. % Mo.

* * * * *